US008860537B2

(12) United States Patent
Sora

(10) Patent No.: US 8,860,537 B2
(45) Date of Patent: Oct. 14, 2014

(54) ELECTROMAGNETIC RELAY

(75) Inventor: Yosuke Sora, Sagamihara (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 0 days.

(21) Appl. No.: 13/704,341

(22) PCT Filed: May 31, 2011

(86) PCT No.: PCT/JP2011/003049

§ 371 (c)(1),
(2), (4) Date: Dec. 14, 2012

(87) PCT Pub. No.: WO2011/158447

PCT Pub. Date: Dec. 22, 2011

(65) Prior Publication Data

US 2013/0093542 A1 Apr. 18, 2013

(30) Foreign Application Priority Data

Jun. 17, 2010 (JP) ..... 2010-138121

(51) Int. Cl.

| | |
|---|---|
| ***H01H 67/02*** | (2006.01) |
| ***H01H 50/00*** | (2006.01) |
| ***H01H 50/16*** | (2006.01) |
| ***H01H 47/22*** | (2006.01) |
| ***H01F 7/16*** | (2006.01) |
| *H01H 47/14* | (2006.01) |

(52) U.S. Cl.

CPC ..... *H01H 50/16* (2013.01); *H01H 47/14* (2013.01); *H01H 50/00* (2013.01); *H01H 47/22* (2013.01); *H01F 7/1607* (2013.01)

USPC ..... 335/126; 335/131

(58) Field of Classification Search

CPC ..... H01F 7/064; H01F 7/018; H01F 7/204

USPC ..... 335/78, 268, 131, 126, 256, 257

See application file for complete search history.

(56) References Cited

U.S. PATENT DOCUMENTS 3,571,668 A * 3/1971 Gray ..... 361/208
3,743,898 A * 7/1973 Sturman ..... 361/194

(Continued)

FOREIGN PATENT DOCUMENTS

CN 1969355 A 5/2007
JP 5-326256 A 12/1993

(Continued)

OTHER PUBLICATIONS

Korean Office Action, Jan. 14, 2014, 4 pages.

(Continued)

*Primary Examiner* — Alexander Talpalatski
(74) *Attorney, Agent, or Firm* — Foley & Lardner LLP

(57) ABSTRACT

An electromagnetic relay includes a fixed iron core, a movable iron core opposed to the fixed iron core, a magnetizing coil for generating a magnetic force when energized to make the movable iron core attracted by the fixed iron core, a movable contact coupled with the movable iron core, a fixed contact opposed to be contacted with the movable contact, a reset spring for reset the movable iron core, and a repulsive-force generating coil. The repulsive-force generating coil generates a magnetic field opposing to a remaining magnetic field of the movable iron core while the movable iron core moves from a position where the movable contact has passed through an arc field where an arc discharge between movable contact and the fixed contact to be occurred to a position where the movable iron core is just about to expand the reset spring fully.

2 Claims, 3 Drawing Sheets

(56) References Cited

U.S. PATENT DOCUMENTS

| | | | | |
|---|---|---|---|---|
| 5,291,170 | A * | 3/1994 | Wahba et al. | 335/246 |
| 6,066,999 | A * | 5/2000 | Pischinger | 335/266 |
| 6,741,441 | B2 * | 5/2004 | Hilbert et al. | 361/160 |
| 7,535,328 | B2 | 5/2009 | Kurasawa et al. | |
| 7,859,373 | B2 * | 12/2010 | Yamamoto et al. | 335/126 |
| 2007/0241847 | A1 | 10/2007 | Yamamoto et al. | |

FOREIGN PATENT DOCUMENTS

| | | | |
|---|---|---|---|
| JP | 2008-34333 | A | 2/2008 |
| JP | 2010-10058 | A | 1/2010 |

OTHER PUBLICATIONS

Chinese Office Action, Jul. 16, 2014, 6 pages.

* cited by examiner

ELECTROMAGNETIC RELAY

TECHNICAL FIELD

The present invention relates to an electromagnetic relay that can be effectively used in control circuits of various electrical devices, such as a control circuit for driving a motor of an electric vehicle.

BACKGROUND ART

A conventional electromagnetic relay is disclosed in a Patent Literature 1 (PTL 1) listed below. The disclosed electromagnetic relay is a polarized electromagnetic relay that intends to reducing power consumption during operation and to improve resetting movement of a movable iron core by providing a permanent magnet with the iron core.

CITATION LIST

Patent Literature

PTL 1: Japanese Patent Application Laid-Open No. 2010-10058

SUMMARY OF INVENTION

Technical Problem

In an electromagnetic relay, an iron core is reset by a reset spring when the relay is de-energized, so that undesirable noise and vibration may be generated due to a contact of the iron core and an end plate of a yoke.

Solution to Problem

Therefore, this tendency may become more noticeable when quickly resetting an iron core as disclosed in the above Patent Literature 1.

An object of the present invention provides an electromagnetic relay that can restrict noise and vibration when de-energized without affecting its operational performance on its de-energization.

An aspect of the present invention provides an electromagnetic relay that includes a fixed iron core; a movable iron core opposed to the fixed iron core so as to be able to be contacted-with or separated-from the fixed iron core along an axial direction; a magnetizing coil that contains the fixed iron core and the movable iron core and generates a magnetic force when energized to make the movable iron core attracted by the fixed iron core; a movable contact coupled with the movable iron core; a fixed contact opposed to the movable contact so as to be contacted-with or distanced from the movable contact along with a movement of the movable iron core; a reset spring that is interposed between the fixed iron core and the movable iron core and separates the movable iron core from the fixed iron core when the magnetizing coil is de-energized; and a repulsive-force generating coil that is disposed adjacent to the magnetizing coil at a reset position of the movable iron core, wherein the repulsive-force generating coil is configured to be able to generate a magnetic field opposing to a remaining magnetic field of the movable iron core at least while the movable iron core moves from a position where the movable contact has passed through an arc field that is a minimal gap between the movable contact and the fixed contact to cause an arc discharge between the movable contact and the fixed contact to a position where the movable iron core is just about to expand the reset spring fully.

DESCRIPTION OF EMBODIMENTS

Embodiments will be explained hereinafter with reference to the drawings.

Figure 1:
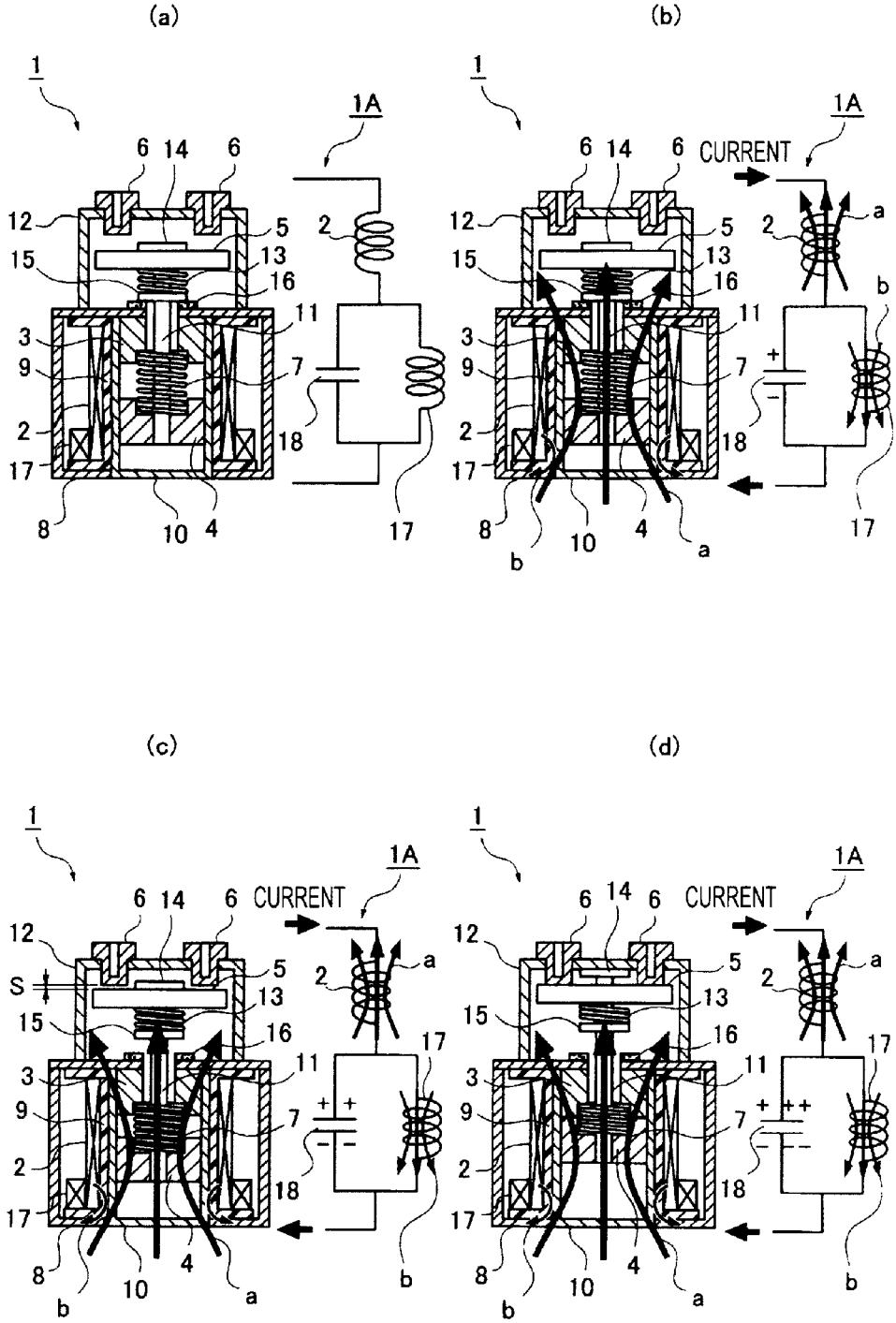
FIG. 1 is an explanatory schematic drawing showing a cross-sectional structure and a driver circuit of an electromagnetic relay according to a first embodiment: (a) shows its de-energized state and (b) to (d) show processes while a capacitor is charged during its energization.
Figure 2:
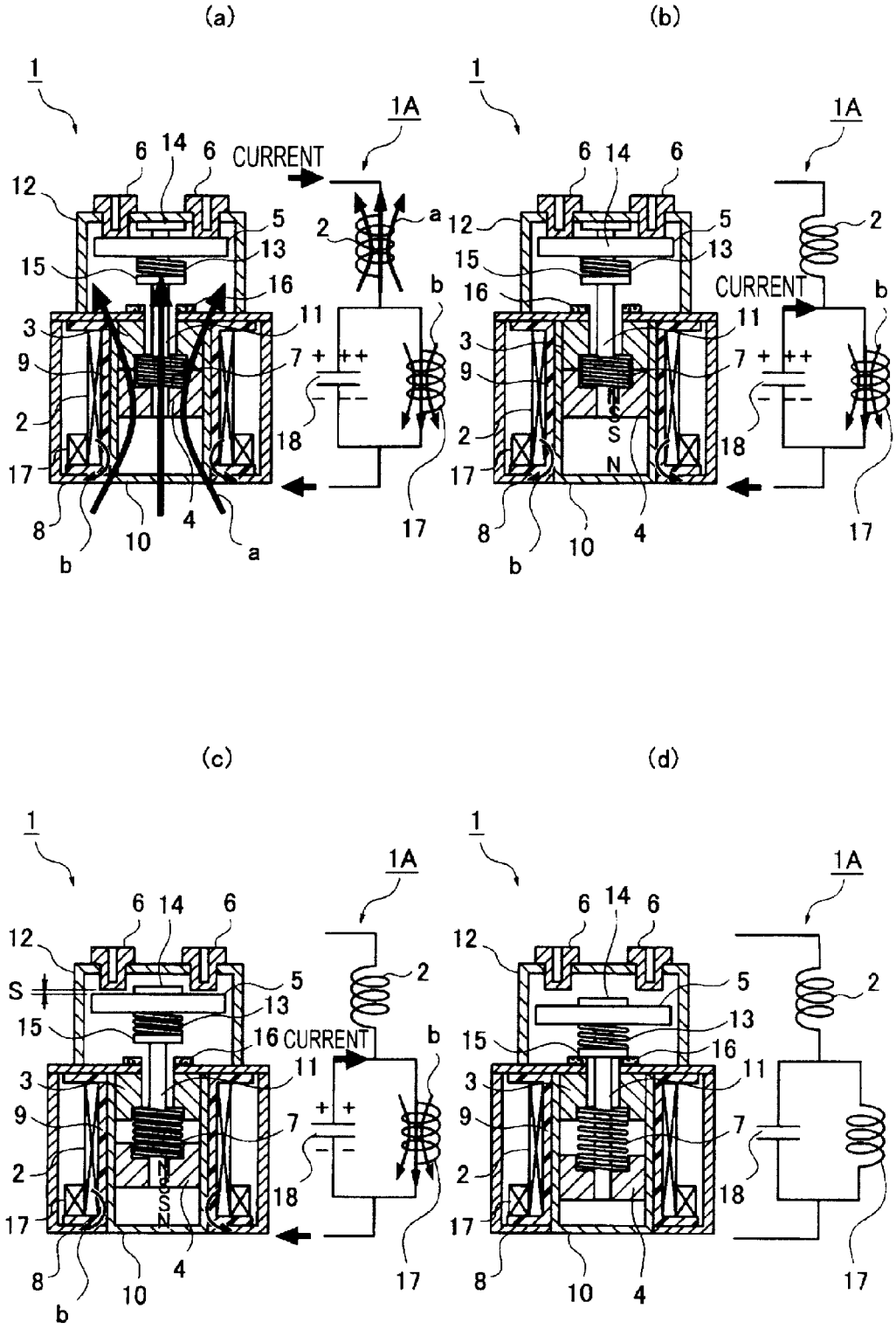
FIG. 2 is an explanatory schematic drawing showing the cross-sectional structure and the driver circuit of the electromagnetic relay according to the first embodiment: (a) to (c) show processes while the capacitor is discharged and (d) shows its de-energized state thereafter.

As shown in FIGS. 1 and 2, an electromagnetic relay 1 according to a first embodiment includes a magnetizing coil 2, a fixed iron core 3, a movable iron core 4, a movable contact 5, fixed contacts 6, and a reset spring 7. The fixed iron core 3 and the movable iron core 4 are to be magnetized due to excitation of the magnetizing coil 2. The movable contact 5 is coupled with the movable iron core 4. The movable contact 5 and fixed contacts 6 face each other. The reset spring 7 is disposed between the fixed iron core 3 and the movable iron core 4.

The magnetizing coil 2 is wound around a bobbin 9 that is inserted in a yoke 8. An iron core case 10 is inserted in the bobbin 9.

The iron core case 10 is formed as a bottomed cylinder, and its open end is fixed to an upper end plate of the yoke 8. The fixed iron core 3 is fixedly disposed at an upper end in the iron core case 10.

The movable iron core 4 is disposed below the fixed iron core 3 within the iron core case 10, and can slide vertically in the iron core case 10. The movable iron core 4 faces the fixed iron core along an axial direction, and can be contacted-with/separated-from the fixed iron core 3.

A counterbore is formed at a center of a facing plane of each of the fixed iron core 3 and the movable iron core 4. The reset spring 7 is interposed between the counterbores, and its both ends are fixed to the counterbores, respectively.

A rod 11 is vertically fixed at a center of the movable iron core 4. The rod 11 penetrates through a center of the fixed iron core 3 and the upper end plate of the yoke 8, and protrudes into an inside of a shield case 12 that is fixed on the upper end plate.

The fixed contacts 6 are disposed so as to penetrate an upper wall of the shield case 12 vertically. On the other hand, the movable contact 5 is disposed, in the shield case 12, at a top of the rod 11 with supported by a pressure-applying spring 13. The pressure-applying spring 13 is to apply a contacting pressure force to the movable contact 5.

Specifically, the movable contact 5 are movably supported between a stopper 14 fixed at a top end of the rod and the pressure-applying spring 13. The pressure-applying spring 13 is interposed between a spring seat 15 fixed to the rod 11 and the movable contact 5.

In the electromagnetic relay 1 configured as above, the fixed iron core 3 and the movable iron core 4 are magnetized when a magnetic force is generated by the magnetizing coil 2 due to energization (FIG. 1(*b*)). Then, the fixed iron core 3 and the movable iron core 4 are attracted with each other, so that the movable iron core 4 and the movable contact 5 are integrally moved in the axial direction (FIG. 1(*c*)). As a result, the movable contact 5 contacts with the fixed contacts 6 to connect desired circuits (FIG. 1(*d*) and FIG. 2(*a*)).

The magnetization of the fixed iron core 3 and the movable iron core 4 are cancelled when the magnetizing coil 2 is demagnetized due to de-energization (FIG. 2(*b*)). Then, the fixed iron core 3 and the movable iron core 4 are separated away with each other due to an expanding force of the reset spring, so that the movable iron core 4 and the movable contact 5 are integrally moved back in the axial direction (FIG. 2(*c*)). As a result, the movable contact 5 is separated away from the fixed contacts 6 to disconnect the above-mentioned circuits (FIG. 2(*d*)).

A minimal gap S (shown in FIG. 1(*c*) for an explanatory illustration) may occurs instantaneously due to an external force during the energization of the electromagnetic relay 1. If the minimal gap S occurs, arc currents may be generated between the movable contact 5 and the fixed contacts 6. Then, the contacts 5 and 6 may be welded together when recontacted with each other. Hereinafter, the minimal gap S is referred as an arc field S.

In addition, if the movable contact 5 and the fixed contacts 6 are not quickly separated with each other on disconnecting the above-mentioned circuits, arc currents may be generated at the arc field S (shown in FIG. 2(*c*)) between the movable contact 5 and the fixed contacts 6. As a result, the circuits cannot be disconnected smoothly and quickly.

Namely, while the contacts 5 an 6 are contacted with each other, it is required that the fixed iron core 3 and the movable iron core 4 are firmly attracted with each other to keep their contacted state. When the contacts 5 and 6 are to be separated from each other from their contacted state, it is required that the contacts 5 and 6 are smoothly and quickly separated from each other.

On the other hand, when the contacts 5 and 6 are separated from each other, the spring seat 15 on the rod 11 contacts with the upper end plate of the yoke 8 and thereby vibration may be generated. In a case where the electromagnetic relay 1 is applied to a control circuit for driving a motor of an electric vehicle, the vibration may be transmitted to a vehicle body and give undesirable feeling to occupants. Here, a gum damper (cushioning member) 16 is provided at a position contacted with the spring seat 15 on the upper end plate of the yoke 8, but the gum damper 16 cannot absorb an impact by the spring seat 15 completely. In addition, an elastic coefficient of the gum damper 16 may change widely due to its degradation and its thermal environment, so that its stable cushioning performance cannot be expected.

To solve these problems, it can be considered to downsize a magnetizing portion of the movable iron core 4 or to reduce a spring force of the reset spring 7. However, if the magnetizing portion of the movable iron core 4 is downsized, a magnetic force of the magnetized movable iron core 4 becomes weak and thereby the contacting pressure becomes insufficient to keep contacting state of the contacts 5 and 6. In addition, if the spring force of the reset spring 7 is reduced, a force for separating the movable iron core 4 away from the fixed iron core 3 on the de-energization becomes weak and thereby the movable iron core 4 cannot be separated smoothly and quickly.

Therefore, a repulsive-force generating coil 17 is provided at a reset location to which the movable iron core 4 is reset by the reset spring 7 on the de-energization. The repulsive-force generating coil 17 generates magnetic repulsive force that mitigates a reset movement of the movable iron core 4.

When the magnetizing coil 2 is demagnetized on the de-energization of the electromagnetic relay 1, remaining magnetism temporally exists in the fixed iron core 3 and the movable iron core 4.

Therefore, a magnetic field opposing to remaining magnetic field of the movable iron core 4 is generated by the repulsive-force generating coil 17 when the movable iron core 4 is separated away, so that a magnetic repulsive force is generated against a magnetism of the movable iron core 4 to mitigate the reset movement of the movable iron core 4.

This repulsive force is generated at the reset location of the movable iron core 4 is reset while the movable iron core 4 moves from a start position of the separation from the fixed iron core 3 to an end position where the movable iron core 4 is just about to expand the reset spring 7 fully. Therefore, the repulsive force can mitigate the reset movement of the movable iron core 4 effectively.

Note that, due to the above-explained reason, it is preferable that the movable contact 5 is quickly separated away from the fixed contacts 6 until the movable contact 5 has passed through the arc field S.

Therefore, it is preferable that, when the movable iron core 4 is separated away from the fixed iron core 3, the repulsive-force generating coil 17 generates a magnetic field opposing to the remaining magnetic field of the movable iron core 4 while the movable iron core 4 moves from a position where the movable contact 5 has passed through the arc field S (not from the above-explained start position) to the end position where the movable iron core 4 is just about to expand the reset spring 7 fully.

Therefore, as explained above, the repulsive-force generating coil 17 is disposed at the reset location of the movable iron core 4 in the present embodiment. Specifically, the repulsive-force generating coil 17 is wound around a lower end portion of the bobbin 9 in a counter-winding direction to a winding direction of the magnetizing coil 2.

In the present embodiment, the repulsive-force generating coil 17 is wound over the magnetizing coil 2 so as to be layer on the magnetizing coil 2 as shown in FIGS. 1 and 2. However, the repulsive-force generating coil 17 and the magnetizing coil 2 may be arranged sequentially aligned with the axial direction.

The repulsive-force generating coil 17 is connected with a capacitor 18 having a prescribed capacity in parallel, and this parallel circuit is connected with the magnetizing coil 2 in series to configure a relay driver circuit 1A.

According to the electromagnetic relay 1 as configured above, the movable iron core 4 stays at an initial position when de-energized as shown in FIG. 1(*a*). The movable iron core 4 at the initial position is urged downward by the reset spring 7 and thereby restricted its vertical movement due to a contact of the spring seat 15 and the upper end plate of the yoke 8 (with interposing the gum damper 16).

When the relay driver circuit 1A is energized in the above de-energized state, the magnetizing coil 2 is excited to generate a magnetic field a (shown by arrows a in FIG. 1(*b*)). As a result, the fixed iron core 3 and the movable iron core 4 are magnetized by the magnetic field a.

The fixed iron core 3 and the movable iron core 4 are attracted to each other due to their own magnetization, and thereby the movable iron core 4 moves upward along the axial direction with compressing the reset spring 7 as shown in FIG. 1(*c*).

The movable iron core 4 has moved along the axial direction toward the fixed iron core 3 with a prescribed slide amount, so that the movable contact 5 contacts with the fixed contacts 6. Sequentially, the movable iron core 4 is further attracted to the fixed iron core 3, and finally contacts with the fixed iron core 3 as shown in FIG. 1(*d*). While the fixed iron core 3 and the movable iron core 4 are contacted with each other, the pressure-applying spring 13 is compressed to apply a prescribed contacting pressure force to the movable contact 5 and the fixed contacts 6.

While the relay driver circuit 1A is energized as shown in FIGS. 1(*b*) to 1(*d*), a current flows through the repulsive-force generating coil 17 and the capacitor 18 is charged in the parallel circuit.

Since the repulsive-force generating coil 17 is wound in the counter-winging direction to the winding direction of the magnetizing coil 2, a magnetic field b (shown by arrows b in FIGS. 1(*b*) to 1(*d*)) is generated by the energization of the repulsive-force generating coil 17 to cancel the magnetic field a generated by the magnetizing coils 2. Therefore, the number of windings and a winding diameter of the coils 2 and 17 are determined so that the magnetic fields a and b generated by the coils 2 and 17 can move the movable iron core 4 toward the fixed iron core 3 and then keep the movable contact 5 contacted with the fixed contacts 6 firmly.

FIGS. 2(*a*) to 2(*d*) show operated states of the electromagnetic relay 1 from its energized state to its de-energized state.

When the electromagnetic relay 1 is energized as shown in FIG. 2(*a*), the capacitor 18 in the relay driver circuit 1A is fully charged.

When the relay driver circuit 1A is de-energized from the energized state, the magnetizing coil 2 is demagnetized but a discharged current from the capacitor 18 flows through the repulsive-force generating coil 17 as shown in FIG. 2(*b*). Therefore, the magnetic field b in FIG. 2(*b*) is generated by the repulsive-force generating coil 17. The magnetic field b generated by the repulsive-force generating coil 17 is opposed to a remaining magnetic field of the movable iron core 4.

In an initial stage of the de-energization of the electromagnetic relay 1, the magnetic field b is generated at a lower area distanced from the movable iron core 4, so that the movable iron core 4 is separated quickly from the fixed iron core 3 by the reset spring 7 with hardly affected by the magnetic repulsive force generated by the magnetic field b. Therefore, the movable contact 5 is quickly separated away from the fixed contacts 6 as shown in FIG. 2(*c*) until the movable contact 5 passes through the arc field S.

When the movable iron core 4 approaches to an field where the magnetic field b is generated after the movable contact 5 has moved form a position passing through the arc field S to a position where the reset spring is just about to be fully expanded, the movable iron core 4 begins to receive the magnetic repulsive force generated by the magnetic field b that is repulsive to the remaining magnetism of the movable iron core 4.

Due to the magnetic repulsive force, the reset movement of the movable iron core 4 by the reset spring 7 is mitigated and then the spring seat 15 is contacted with the gum damper 16 as shown in FIG. 2(*d*), so that an impact on resetting is reduced.

According to the electromagnetic relay 1 in the first embodiment, on the de-energization, the movable iron core 4 can be quickly separated away from the fixed iron core 3 by the reset spring 7 to separate the contacts 5 and 6. During the separation movement of the movable iron core 4, the magnetic repulsive force is generated by the magnetic field b of the repulsive-force generating coil 17 against the remaining magnetism of the movable iron core 4. As a result, the reset movement of the movable iron core 4 can be mitigated and thereby noise and vibration due to a contact of the spring seat 15 and the upper end plate of the yoke 8 are reduced.

Therefore, it is not required to downsize the movable iron core 4 or to reduce a spring force of the reset spring 7, so that noise and vibration can be restricted without affecting an operational performance of the electromagnetic relay 1 on its de-energization.

According to the present embodiment, since a specific electrical control is made unnecessary by adding only the parallel circuit including the repulsive-force generating coil 17 having the counter-winding direction to the winding direction of the magnetizing coil 2 and the capacitor 18, the electromagnetic relay 1 has an advantage in cost.

Figure 3:
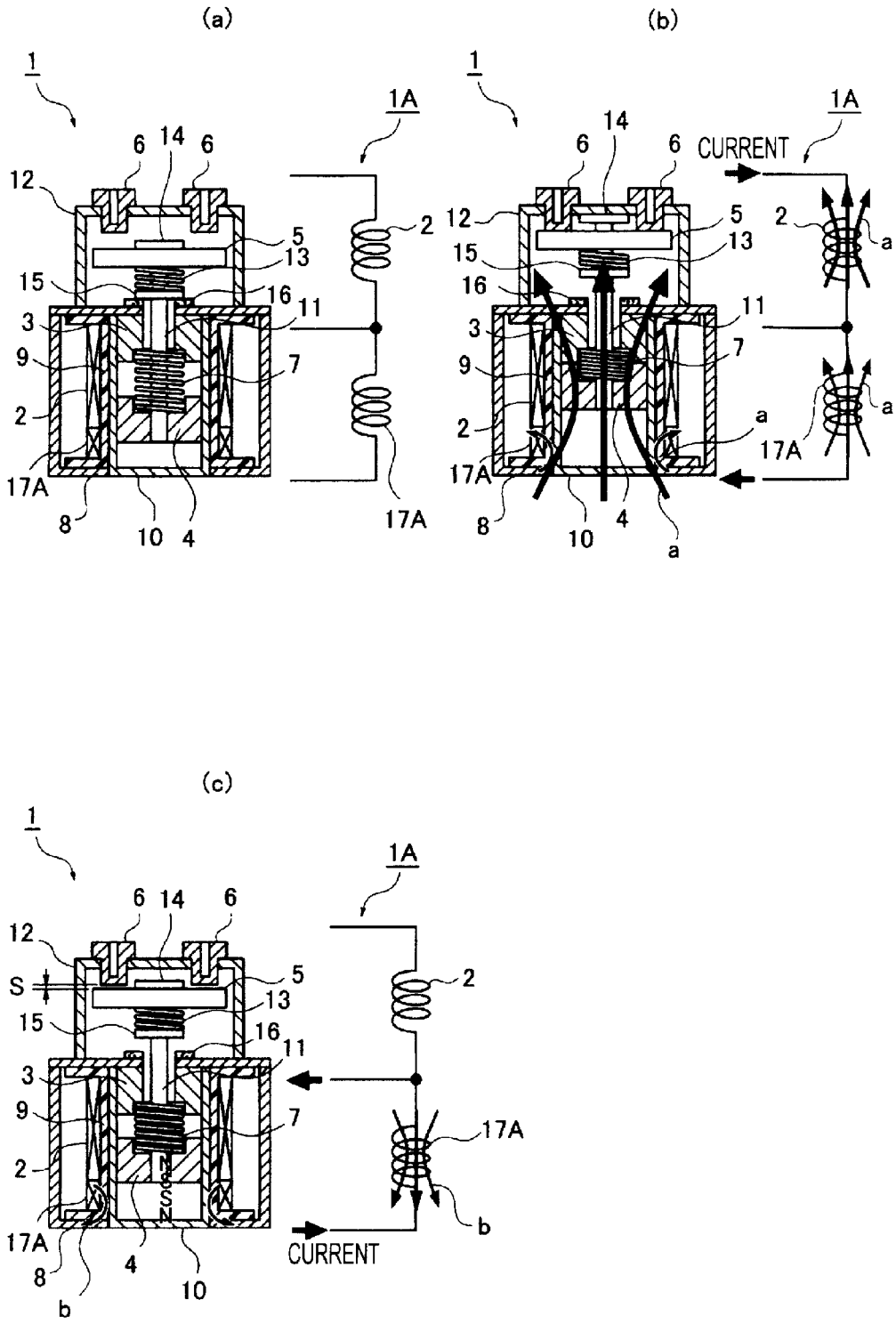
FIG. 3 is an explanatory schematic drawing showing a cross-sectional structure and a driver circuit of an electromagnetic relay according to a second embodiment: (a) shows its de-energized state, (b) shows a state during its energization, and (c) shows a state during its de-energization.

As shown in FIG. 3, an electromagnetic relay 1 according to a second embodiment has a different configuration in that a repulsive-force generating coil 17A having a winding direction same as a winding direction of the magnetizing coil 2 is formed by divided a lower portion of the magnetizing coil 2. Other elements or magnetic fields those are identical or similar to those in the first embodiment are indicated with identical numerals, and their redundant explanations are omitted.

In the relay driver circuit 1A, the magnetizing coil 2 and the repulsive-force generating coil 17A are connected in series, and a switching circuit is provided between them. By the switching circuit, a current is flown only through the repulsive-force generating coil 17A on the de-energization of the electromagnetic relay 1. On the other hand, a current is sequentially flown through both of the repulsive-force generating coil 17A and the magnetizing coil 2 on or during the energization of the electromagnetic relay 1. Here, a current direction flowing through the repulsive-force generating coil 17A on the de-energization is made reversed to that on or during the energization. Therefore, a direction of a magnetic field on the de-energization is counter to that on or during the energization.

In the electromagnetic relay 1 according to the present embodiment, the movable iron core 4 stays at an initial position when de-energized as shown in FIG. 3(*a*). The movable iron core 4 at the initial position is urged downward by the reset spring 7 and thereby restricted its vertical movement due to a contact of the spring seat 15 and the upper end plate of the yoke 8 (with interposing the gum damper 16).

When the relay driver circuit 1A is energized in the above de-energized state, the magnetizing coil 2 and the repulsive-force generating coil 17A are excited to generate magnetic fields a (shown by arrows a in FIG. 3(*b*)). The magnetic fields a are generated in the same direction.

As a result, the fixed iron core 3 and the movable iron core 4 are magnetized by the magnetic fields a, and attract to each other. When the movable contact 5 contacts with the fixed contacts 6, the pressure-applying spring 13 is compressed to apply a prescribed contacting pressure force to the movable contact 5 and the fixed contacts 6.

When the relay driver circuit 1A is de-energized from the energized state, the magnetizing coil 2 and the repulsive-force generating coil 17A are demagnetized, and thereby the fixed iron core 3 and the movable iron core 4 are demagnetized. The movable iron core 4 can be separated quickly from the fixed iron core 3 by the reset spring 7 to separate the movable contact 5 and the fixed contacts 6 quickly.

During this separation process of the movable iron core 4, a current flowing reversely to the current at the energization is flown only through the repulsive-force generating coil 17A to generate a magnetic field b (shown by arrows b in FIG. 3(*c*)) by the above-mentioned switching circuit. The magnetic field b generated by the repulsive-force generating coil 17A is opposed to a remaining magnetic field of the movable iron core 4.

The energization of the repulsive-force generating coil 17A by the switching circuit is started, for example, within a time period from a time when the movable contact 5 has passed through the arc field S to a time when a time when the movable iron core 4 is just about to expand the reset spring 7 fully.

As a result, the movable iron core 4 receives a magnetic repulsive force generated by the magnetic field b that is repulsive to the remaining magnetism to the movable iron core 4 when the reset spring 7 is just about to be expanded fully. Due to the magnetic repulsive force, the separation/reset movement of the movable iron core 4 by the reset spring 7 is mitigated and then the spring seat 15 is contacted with the gum damper 16, so that an impact on resetting is reduced.

According to the present embodiment, noise and vibration can be restricted without affecting an operational performance of the electromagnetic relay 1 on its de-energization similarly to the first embodiment.

Especially, the repulsive-force generating coil 17A is formed by dividing a portion of the magnetizing coil 2 in the present embodiment, so that a configuration of an exciting coil can be simplified without the need of an additional coil.

In addition, a current value, a start time, a duration time and so on of the current flown through the repulsive-force generating coil 17A by the switching circuit can be adjusted arbitrarily, so that an appropriate mitigation effect for the movable iron core 4 can be achieved.

The entire contents of Japanese Patent Application 2010-138121 (filed Jun. 17, 2010) are incorporated herein by reference.

Although the invention has been described above by reference to certain embodiments of the invention, the invention is not limited to the embodiments described above. Modifications and variations of the embodiments described above will occur to those skilled in the art, in light of the above teachings.

The invention claimed is:

1. An electromagnetic relay comprising:

a fixed iron core;

a movable iron core opposed to the fixed iron core so as to be able to be contacted-with or separated-from the fixed iron core along an axial direction;

a magnetizing coil that contains the fixed iron core and the movable iron core and generates a magnetic force when energized to make the movable iron core attracted by the fixed iron core;

a movable contact coupled with the movable iron core;

a fixed contact opposed to the movable contact so as to be contacted-with or distanced-from the movable contact along with a movement of the movable iron core;

a reset spring that is interposed between the fixed iron core and the movable iron core and separates the movable iron core from the fixed iron core when the magnetizing coil is de-energized;

a repulsive-force generating coil that is disposed adjacent to the magnetizing coil at a reset position of the movable iron core, and a capacitor connected with the repulsive-force generating coil in parallel to configure a parallel circuit, wherein the repulsive-force generating coil is configured to generate a magnetic field opposing to a remaining magnetic field of the movable iron core at least while the movable iron core moves from a position where the movable contact has passed through an arc field that is a minimal gap between the movable contact and the fixed contact to cause an arc discharge between the movable contact and the fixed contact to a position where the movable iron core is just about to expand the reset spring fully, the parallel circuit is serially connected with the magnetizing coil to configure a relay driver circuit, the capacitor is configured to be charged when the relay driver circuit is energized, and the relay driver circuit is configured such that the magnetic field opposing to the remaining magnetic field of the movable iron core is generated by a discharged current from the capacitor while the relay driver circuit is de-energized.

2. An electromagnetic relay comprising:

a fixed iron core;

a movable iron core opposed to the fixed iron core so as to be able to be contacted-with or separated-from the fixed iron core along an axial direction;

a magnetizing coil that contains the fixed iron core and the movable iron core and generates a magnetic force when energized to make the movable iron core attracted by the fixed iron core;

a movable contact coupled with the movable iron core;

a fixed contact opposed to the movable contact so as to be contacted-with or distanced-from the movable contact along with a movement of the movable iron core;

a reset spring that is interposed between the fixed iron core and the movable iron core and separates the movable iron core from the fixed iron core when the magnetizing coil is de-energized;

a repulsive-force generating coil that is disposed adjacent to the magnetizing coil at a reset position of the movable iron core; and a switching circuit that is connected with the magnetizing coil and the repulsive-force generating coil, the switching circuit configured to flow a current in a reverse direction only through the repulsive-force generating coil when the electromagnetic relay is de-energized, the reverse direction opposite to a direction in which a current flows through the magnetizing coil and the repulsive-force generating coil when the electromagnetic relay is energized, wherein the repulsive-force generating coil is configured to generate a magnetic field opposing to a remaining magnetic field of the movable iron core at least while the movable iron core moves from a position where the movable contact has passed through an arc field that is a minimal gap between the movable contact and the fixed contact to cause an arc discharge between the movable contact and the fixed contact to a position where the movable iron core is just about to expand the reset spring fully, and the magnetizing coil is a portion of a single coil having a single winding direction and the repulsive-force generating coil is a remaining portion of the single coil.

* * * * *